US011779091B2

(12) United States Patent
Siu

(10) Patent No.: US 11,779,091 B2
(45) Date of Patent: Oct. 10, 2023

(54) HAIR STYLING APPARATUS WITH ION EMITTER

(71) Applicant: CONAIR CORPORATION, Stamford, CT (US)

(72) Inventor: Kwan Shing Benny Siu, Tseung Kwan O (HK)

(73) Assignee: Conair LLC, Stamford, CT (US)

( * ) Notice: Subject to any disclaimer, the term of this patent is extended or adjusted under 35 U.S.C. 154(b) by 214 days.

(21) Appl. No.: 16/996,084

(22) Filed: Aug. 18, 2020

(65) Prior Publication Data

US 2022/0053902 A1 Feb. 24, 2022

(51) Int. Cl.
*A45D 1/02* (2006.01)
*A45D 1/14* (2006.01)

(52) U.S. Cl.
CPC ..... *A45D 1/14* (2013.01); *A45D 1/02* (2013.01); *A45D 2200/202* (2013.01)

(58) Field of Classification Search
CPC ... A45D 1/00; A45D 1/02; A45D 1/04; A45D 1/06; A45D 1/08; A45D 1/10; A45D 1/14; A45D 1/16; A45D 1/20; A45D 2/00; A45D 2/001; A45D 2/02; A45D 2/04; A45D 2/06
USPC ..... 401/137–139; 132/222–225, 269, 272
See application file for complete search history.

(56) References Cited

U.S. PATENT DOCUMENTS 7,478,640 B2 1/2009 Saida et al.
2005/0172979 A1* 8/2005 Saida ..... A45D 1/04 132/228
2005/0224091 A1* 10/2005 Cafaro ..... A45D 1/04 132/228
2006/0076032 A1* 4/2006 Fung ..... A45D 1/06 132/224
2006/0108344 A1* 5/2006 Kim ..... A45D 20/50 392/379

(Continued)

FOREIGN PATENT DOCUMENTS

AU 2011202604 A1 6/2011
CN 102987701 A 3/2013

(Continued)

OTHER PUBLICATIONS

CN203575843U. Machine Translation (Year: 2014).*

(Continued)

*Primary Examiner* — Cris L. Rodriguez
*Assistant Examiner* — Karim Asqiriba
(74) *Attorney, Agent, or Firm* — Ruggiero McAllister & McMahon LLC

(57) ABSTRACT

A hair styling apparatus includes a first member and a second member extending along a central longitudinal axis. The first member and the second member are configured for relative movement between an open position for receiving hair therebetween and an approximated position. The first member and second member each include an inner plate segment and an outer shell segment. The first member and the second member are each configured to impart a straightening effect on hair when clamped with the inner plate segment. A heating assembly is connected via the inner plate segment to the first member and the second member. At least one ion emitter is for generating ions upon activation of the hair styling apparatus.

13 Claims, 6 Drawing Sheets

(56) References Cited

U.S. PATENT DOCUMENTS

| | | | | |
|---|---|---|---|---|
| 2007/0085036 | A1* | 4/2007 | Santhouse | A45D 20/12 250/492.21 |
| 2013/0247407 | A1 | 9/2013 | Richmond et al. | |
| 2016/0166037 | A1* | 6/2016 | Teramoto | A45D 1/04 132/271 |
| 2017/0196333 | A1* | 7/2017 | Leung | A45D 2/12 |
| 2018/0177272 | A1* | 6/2018 | Nakasone | A45D 1/06 |

FOREIGN PATENT DOCUMENTS

| | | | | |
|---|---|---|---|---|
| CN | 203575843 | U * | 5/2014 | A45D 1/04 |
| CN | 203575843 | U | 5/2014 | |
| EP | 2 433 519 | A1 | 3/2012 | |
| JP | 2003-310339 | A | 11/2003 | |
| JP | P2011-5130 | A | 1/2011 | |
| JP | P2011-5145 | A | 1/2011 | |
| JP | 5260776 | P | 5/2013 | |
| JP | 5663400 | P | 12/2014 | |
| JP | 2015-10448 | A | 6/2015 | |
| KR | 10-1144163 | | 5/2012 | |
| KR | 10-1842932 | | 3/2018 | |

OTHER PUBLICATIONS

International Search Report dated Dec. 8, 2021 from corresponding International Patent Application No. PCT/US2021/045357, 2 pages.
Written Opinion dated Dec. 8, 2021 from corresponding International Patent Application No. PCT/US2021/045357, 6 pages.

* cited by examiner

HAIR STYLING APPARATUS WITH ION EMITTER

BACKGROUND OF THE DISCLOSURE

1. Field of the Disclosure

The present disclosure relates to devices for styling hair. The present disclosure further relates to a hair styling apparatus with ion emitter.

2. Description of the Related Art

Delivering ions or ionically charged molecules to a person's hair provides benefits including the removal of undesirable static charge that naturally occurs in hair. For example, U.S. Pat. No. 7,644,511 filed Jun. 27, 2007 ("Ishikawa") provides a hair dryer that discharges ions. In particular, Ishikawa provides a hair dryer that has a main body housing having an inlet port and a discharge port, an air flow path with the air flow path extending from the inlet port to the discharge port and a bypass flow path with the bypass flow path branching off from the air flow path and leading to an ion emission port. Further, Ishikawa requires an auxiliary air inlet associated with the ion emission port. This structure results in the auxiliary air inlet and the ion emission port being in communication with the hair dryer's main inlet and outlet.

SUMMARY OF THE DISCLOSURE

A hair styling apparatus that is a 2-in-1 styler that emits ions while functioning as a curling iron or a hair straightener is provided.

A hair styling apparatus is further provided with an ion emitter in a housing that has an inlet and an outlet that are not in communication with a hair dryer's main inlet and outlet.

A hair styling apparatus embodiment is provided that includes a first member and a second member extending along a central longitudinal axis. The first member and the second member are configured for relative movement between an open position for receiving hair therebetween and an approximated position. The first member and second member each include an inner plate segment and an outer shell segment. The first member and the second member are each configured to impart a straightening effect on hair when clamped with the inner plate segment. A heating assembly is connected via the inner plate segment to the first member and the second member. At least one ion emitter is for generating ions upon activation of the hair styling apparatus.

The above and other objects, features, and advantages of the present disclosure will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

The present disclosure will be more completely understood in consideration of the following detailed description in connection with the accompanying drawings, in which.

DETAILED DESCRIPTION OF THE DISCLOSURE

Figure 1:
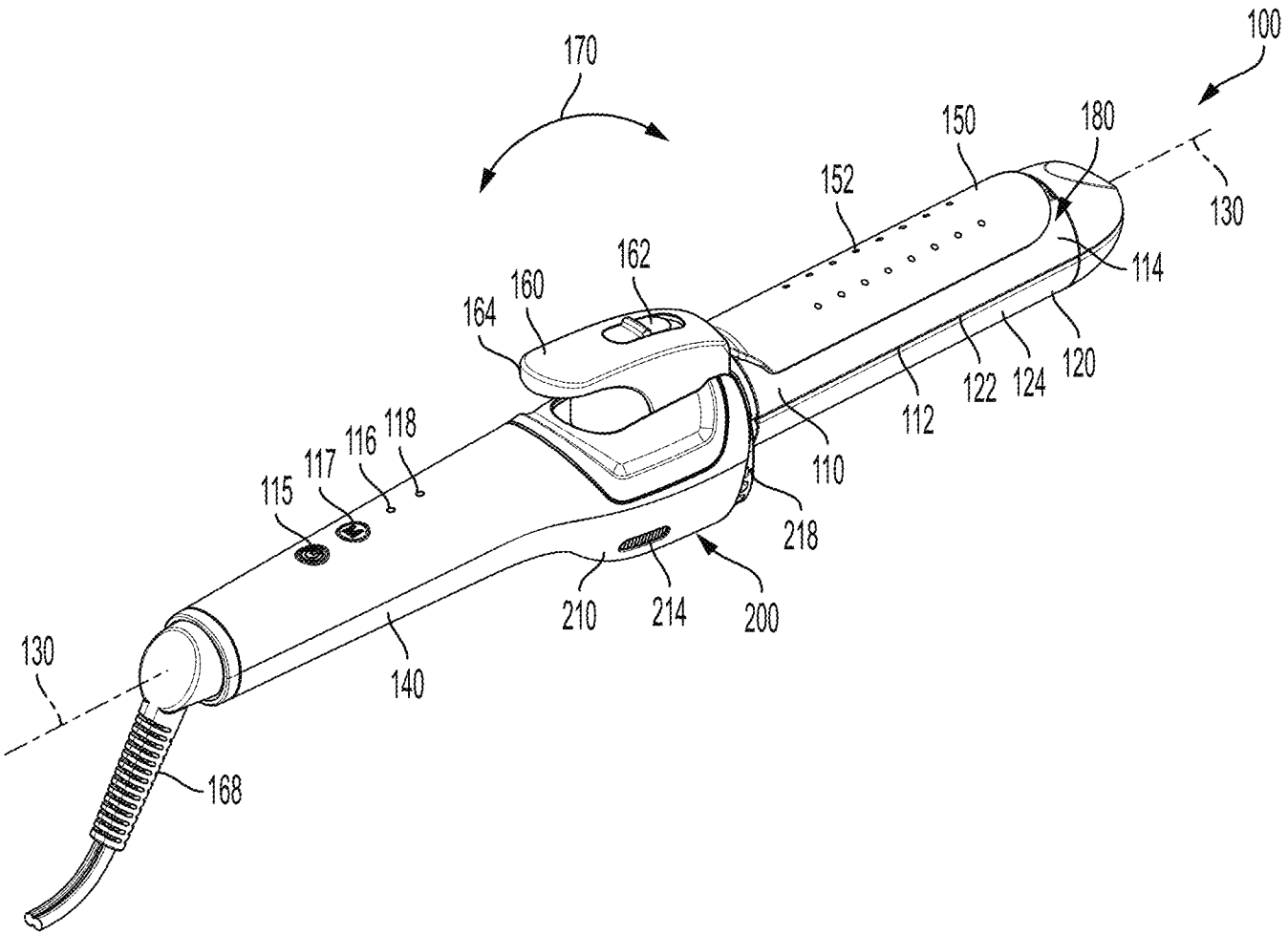
FIG. 1 is a top, rear perspective view of a hair styling apparatus having an ion emitter of the present disclosure.
Figure 2:
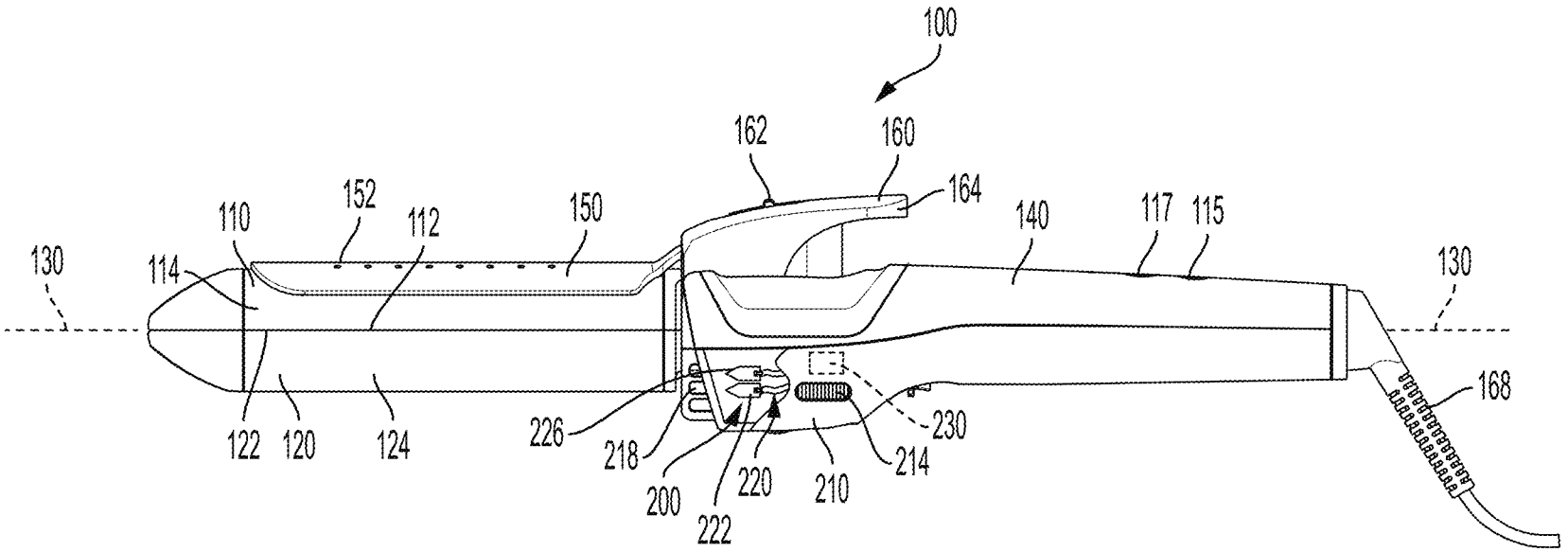
FIG. 2 is a side view of the hair styling apparatus of FIG. 1 having a portion of a housing removed.

Referring to FIGS. 1 and 2, there is provided a hair styling apparatus generally represented by reference numeral 100 having two ion emitter assemblies 200. Alternatively, hair styling apparatus 100 has only one ion emitter assembly 200 or more than two ion emitter assemblies 200. Hair styling apparatus 100 is a 2-in-1 styler that emits ions while functioning as a curling iron or a hair straightening iron.

Referring to FIG. 1, hair styling apparatus 100 has a first member 110 and a second member 120 that extend along a central longitudinal axis 130. First member 110 is shaped to have a flat surface 112 and a curve surface 114 opposite to flat surface 112. Second member 120 has a shape that is a mirror image of first member 110 to have a flat surface 122 and a curve surface 124 opposite to flat surface 122. Curve surfaces 114, 124 each form an outer shell segment. First member 110 and second member 120 are connected to a handle 140 so that at least one of first member 110 and second member 120 are movable relative to each other. Handle 140 preferably has a shape to be griped by a user. Handle 140 is connected to a housing 210 of each of ion emitter assemblies 200. Handle 140 and housing 210 are shown as being formed by one piece. However, housing 210 can be formed separately, and, then, connected to handle 140. Housing 210 has an air inlet 214 and an air outlet 218. Air inlet 214 is through a side of handle 140 and has openings to allow air to therethrough. The openings of air inlet 214 are sized to prevent fingers passing through the openings of air inlet 214. Air outlet 218 is through a front of handle 140 and has openings to allow air to therethrough. The openings of air outlet 218 are sized to prevent fingers passing through the openings of air outlet 218.

First member 110 and second member 120 are made of conductive materials. Handle 140 is made of an insulative material.

Figure 3:
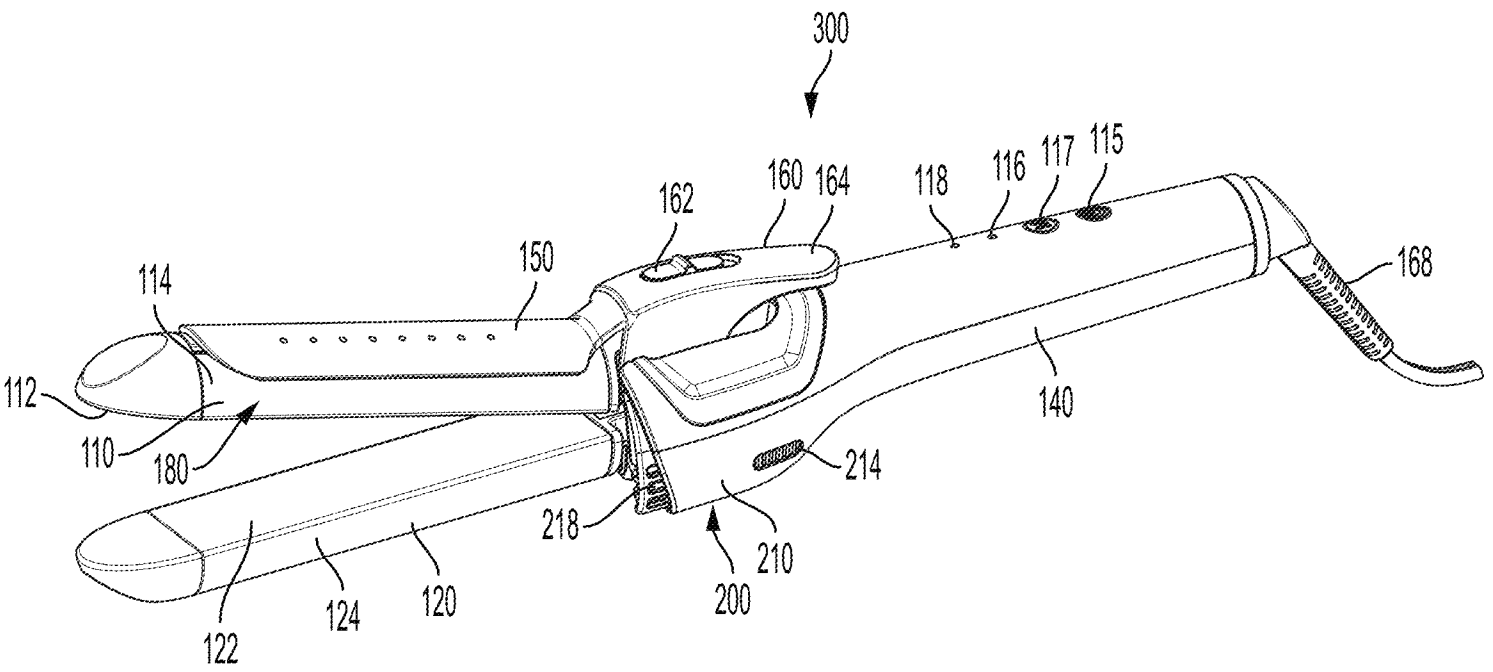
FIG. 3 is a top, front perspective view of the hair styling apparatus of FIG. 1 in an open position of a straightening configuration.
Figure 5:
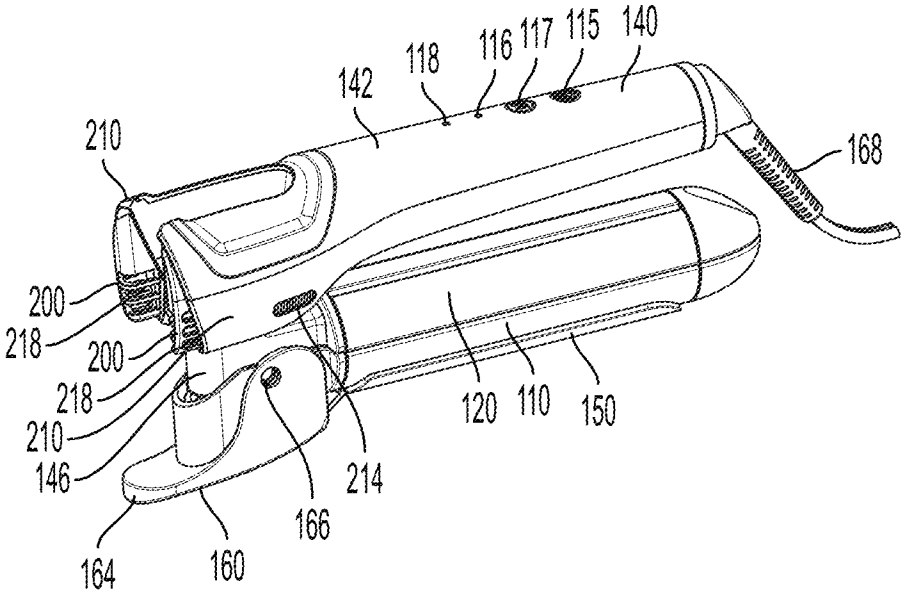
FIG. 5 is a top, front perspective view of the hair styling apparatus of FIG. 1 in a folded position.

Hair styling apparatus 100 has a clamp segment 150. Clamp segment 150 is shaped to mate with first member 110. Clamp segment 150 has one or more holes, preferably two or more holes 152. Clamp segment 150 is connected to a lever 160. Lever 160 is connected to handle 140 by a hinge 166 that is shown in FIG. 5 so that lever 160 selectively rotates about the hinge in directions as shown by arrows 170 toward and away from handle 140 when a force is applied to a user engageable portion 164 of lever 160. Lever 160 is connected to a biasing mechanism, for example, a spring, that biases lever 160 to a position as shown in FIG. 1. Lever 160 has a function button 162. Function button 162 is selectively movable between a curling iron position as shown in FIG. 1 and a straightener position as shown in FIG. 3. When button 162 is in the curling iron position, button 162 disconnects lever 160 from first member 110 while button 162 is connected to clamp segment 150 so that clamp segment 150 moves with lever 160 about hinge 166 and first member 110 is not moved by lever 160 and is maintained in the approximated position. When button 162 is in the straightener position, button 162 connects first member 110 to lever 160 so that first member 110 and clamp segment 150 move together with lever 160 about the hinge. Clamp segment 150 is made of conductive materials or include conductive components. Lever 160 is made of insulative materials.

Referring again to FIG. 1, handle 110 has a power button 115 and an ion button 117. Power button 115 is selectively depressed to turn hair styling apparatus 100 on and off. Ion button 117 selectively activates or deactivates generation of ions by ion generator assemblies 200. Handle 140 has a power indicator light 116 that is illuminated only when hair styling apparatus 100 is on and a ion indicator light 118 that provides an indication of whether ions are generated by ion generator assemblies 200, for example, by illuminating only when ions are being generated by ion generator assembly 200. Power indicator light 116 and ion indicator light 118 can be LED lights. Handle 140 is connected to a power cord 168 that supplies power. Power cord 168 can supply power to a heater assembly 180 of hair styling apparatus 100. Heater assembly 180 conducts heat to one or more of clamp segment 150, first member 110 and second member 120 when power button 115 has been depressed turning on hair styling apparatus 100.

Referring to FIG. 2, each ion emitter assembly 200 has an ion emitter 220 inside housing 210. Ion emitter 220 has a negative ion emitter 222 and a positive ion emitter 226. Accordingly, there is one pair of positive ion emitter 226 and negative ion emitter 222. Both positive ion emitter 226 and negative ion emitter 222 are located inside of air outlet 218. The openings of air inlet 214 and the openings of air outlet 218 allow air to pass through. Since auxiliary air will be drawn in circulation for positive ion emitter 226 and negative ion emitter 222, this will bring extra positive and negative ions that are emitted out of housing 210. This, in other words, helps to increase a total amount of positive and negative ions during use of hair styling apparatus 100. Airflow can pass through the openings of air inlet 214 and the openings of air outlet 218 during use without an airflow generator. Alternatively, the airflow can be generated by an airflow generator 230 that draws air into air inlet 214 and expels air through air outlet 218, for example, a fan in housing 210.

Referring to FIG. 3, in use, a user connects power cord 168 to a power source, for example, a plug in an electrical outlet. The user depresses power button 115 to turn hair styling apparatus 100 on supplying power to heater assembly 180 to heat one or more of clamp segment 150, first member 110 and second member 120. The user can determine if ion generator assemblies 200 are generating ions by ion indicator light 118. If ion indicator light 118 is illuminated, then ion generator assemblies 200 are generating ions. If ion indicator light 118 is not illuminated, then ion generator assemblies 200 are not generating ions and the user can depress ion button 117 supplying power to ion generator assemblies 200 to generate ions. When user depresses ion button 117, power can also be supplied to airflow generator 230 to draw air into air inlet 214 and expels air through air outlet 218 creating an airflow to move ions out of air outlet 218. If the user does not desire ions to be emitted during use of hair styling apparatus 100, then the user can depress ion button 117 to stop supply of power to ion generator assemblies 200, or ion generator assemblies 200 and airflow generator 230, to stop generating ions. When the user has completed use of hair styling apparatus 100 the user depresses power button 115 to turn hair styling apparatus 100 off that stops supply of power to all of ion emitter assemblies 200, heater assembly 180, airflow generator 230, and any combination thereof.

To use hair styling apparatus 100 in the straightening configuration, the user determines if hair styling apparatus 100 is in the straightening configuration as indicated by a position of function button 162. As shown in FIG. 3, hair styling apparatus 100 is in the straightening configuration. However, if function button 162 is in the curling configuration, the user can apply a force to function button 162 to move function button 162 from the position of FIG. 1 to the position shown in in FIG. 3 to connect lever 160 with first member 110. First member 110 is configured for movement relative to second member 120 between an open position for receiving hair therebetween, as shown in FIG. 3, and an approximated position, as shown in FIG. 1. The user applies a force in a direction as shown by arrow 300 on engageable portion 164 to push lever 160 from the approximated position to the open position to insert the user's hair. The user releases the force applied to engageable portion 164 in the direction as shown by arrow 300 allowing the biasing mechanism to move first member 110 closer to second member 120 clamping the user's hair between first member 110 closer to second member 120. Flat surfaces 112,122 each form an inner plate segment configured to impart a straightening effect on the user's hair when the user's hair is clamped between first member 110 and second member 120. Heat is generated by heater assembly 180 that is conducted to flat surfaces 112,122. Flat surfaces 112, 122 apply heat to the hair to impart the straightening effect. If ion emitter assemblies 200 are activated, then each ion emitter assembly 200 draws auxiliary air in circulation for positive ion emitter 226 and negative ion emitter 222 to bring extra positive and negative ions that are emitted out of housing 210 into contact with the user's hair while the user's hair is clamped between first member 110 and second member 120. The positive and negative ions can remove undesirable static charge that naturally occurs in hair. Removal of static charge provides benefits, e.g., smooth hair, no static fly-aways, reduced frizz. The user applies a force in the direction as shown by arrow 300 on engageable portion 164 to push lever 160 to the open position to release the user's hair. The user can then insert the same or a different section of the user's hair between first member 110 and second member 120 to impart the straightening effect.

Figure 4:
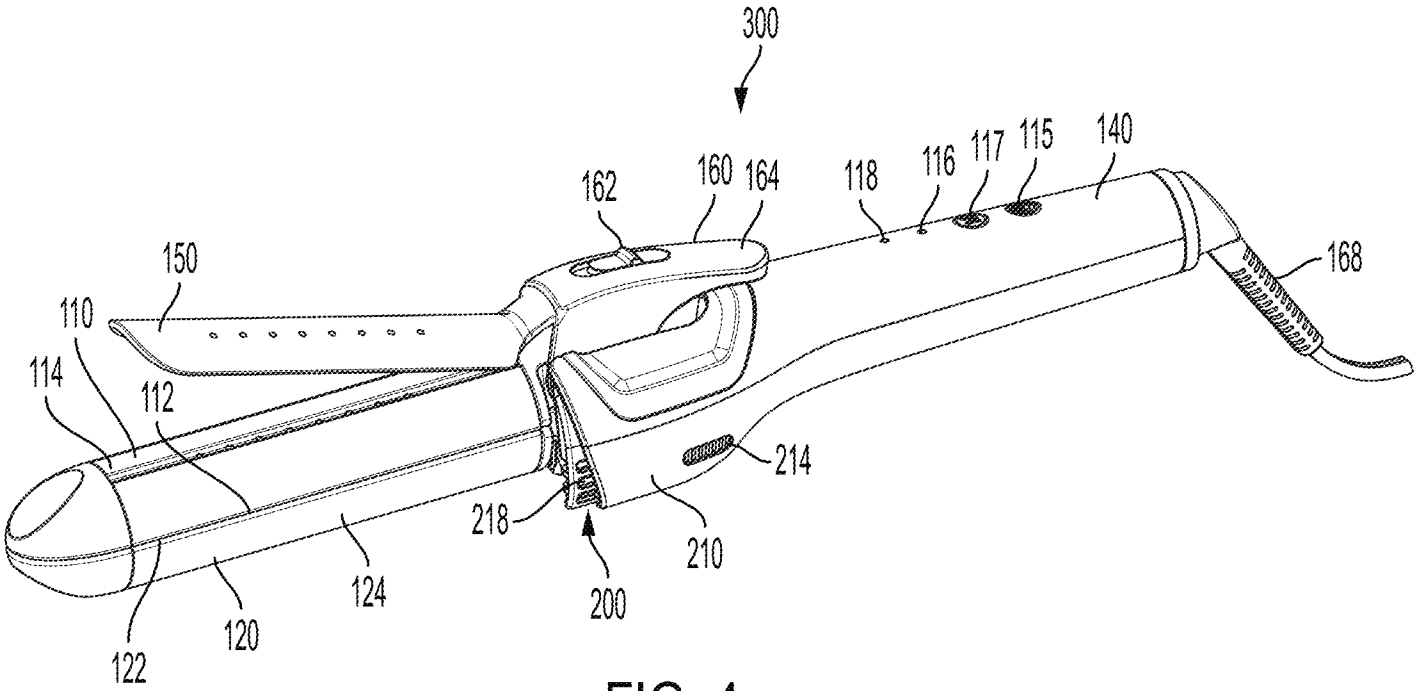
FIG. 4 is a top, front perspective view of the hair styling apparatus of FIG. 1 in a spaced apart position of a curling configuration.

Referring to FIG. 4, to use hair styling apparatus 100 in the curling configuration, the user determines if hair styling apparatus 100 is in the curling configuration as indicated by a position of function button 162. As shown in FIG. 4, hair styling apparatus 100 is in the curling configuration. However, if function button 162 is in the straightening configuration, the user can apply a force to function button 122 to move function button 162 from the position of FIG. 3 to the position shown in in FIG. 4 to disconnect lever 160 from first member 110 while button 162 is connected to clamp segment 150 so that clamp segment 150 moves with lever 160 about the hinge and first member 110 is not moved by lever 160 and is maintained in the approximated position. The user applies a force in a direction as shown by arrow 300 on engageable portion 164 to push lever 160 from the closed position to the spaced apart position to insert the user's hair. The user releases the force applied to engageable portion 164 in the direction as shown by arrow 300 allowing the biasing mechanism to move clamp segment 150 closer to first member 110 clamping the user's hair between clamp segment 150 and first member 110. The heat applied by heater assembly 180 to one or more of clamp segment 150, first member 110 and second member 120 while the user's hair is clamped between clamp segment 150 and first member 110 imparts a curling effect to the user's hair. If ion emitter assemblies 200 are activated, then each ion emitter assembly 200 draws auxiliary air in circulation for positive ion emitter 226 and negative ion emitter 222 to bring extra positive and negative ions that are emitted out of housing 210 into contact with the user's hair while the user's hair is clamped between clamp segment 150 and first member 110. The positive and negative ions can remove undesirable static charge that naturally occurs in hair. Removal of static charge provides benefits, e.g., smooth hair, no static fly-aways, reduced frizz. The user applies a force in the direction as shown by arrow 300 on engageable portion 164 to push lever 160 to the open position to release the user's hair. The user can then insert the same or a different section of the user's hair between clamp segment 150 and first member 110 to impart the curling effect.

Figure 7:
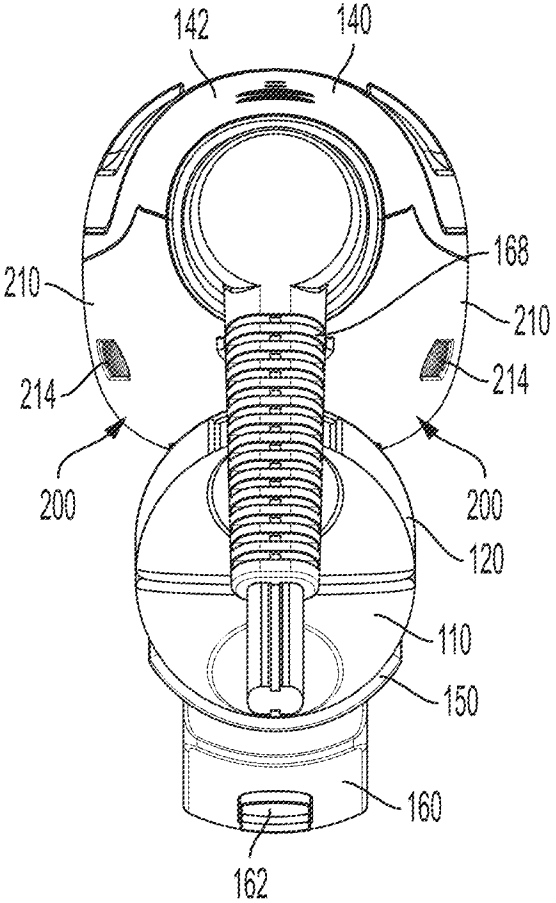
FIG. 7 is a rear view of the hair styling apparatus of FIG. 1 in the folded position.
Figure 6:
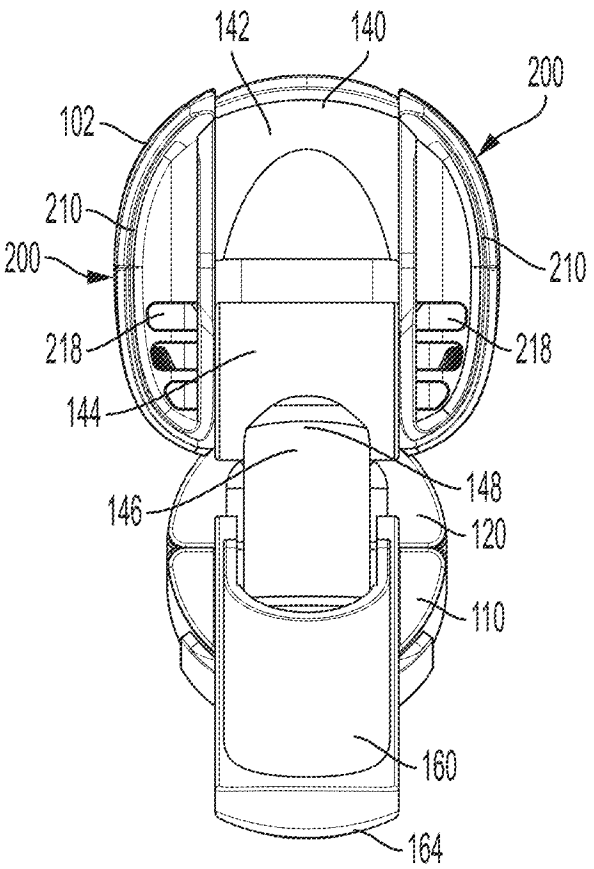
FIG. 6 is a front view of the hair styling apparatus of FIG. 1 in the folded position.

Referring to FIGS. 5-7, handle 110 is foldable. Handle 140 has a first section 142 and a second section 146. First section 142 is connected to second section 146 so that first section 142 and second section 146 are rotatable relative to one another.

Referring to FIG. 6, first section 142 has an outer connector 144 and second section 146 has an inner connector 148. Outer connector 144 and inner connector 148 are on a side of handle opposite to power button 115. Outer connector 144 is connected on opposite sides of inner connector 148 to form a hinge connection. For example, inner connector 148 has an opening and a pin passes through the opening in inner connector 148 and outer connector 144 connects to opposite sides of the pin. Second section 146 rotates first member 110 and second member 120 relative to first section 142 between an extended position, as shown in FIG. 1, and a folded position as shown in FIG. 5. Accordingly, hair styling apparatus 100 in the folded position is compact for storage or transportation.

Hair styling apparatus 100 including at least one ion emitter assembly 200 in housing 210 that has air inlet 214 and air outlet 218 that are not in communication with a hair dryer's main inlet and outlet overcome the disadvantages associated therewith. Further, hair styling apparatus 100 that has at least one ion emitter assembly 200 provides all the benefits of discharging positive and negative ions while straightening or curling the user's hair.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

The invention claimed is:

1. A hair styling apparatus comprising:

a first member and a second member extending along a central longitudinal axis, the first member and the second member being configured for relative movement between an open position for receiving hair therebetween and an approximated position, the first member and second member each including an inner plate segment and an outer shell segment, wherein the first member and the second member are each configured to impart a straightening effect on hair when clamped with the inner plate segment, a heating assembly connected via the inner plate segment to the first member and the second member; and at least one ion emitter for generating ions upon activation of the hair styling apparatus, wherein the first member and the second member are connected to a handle, wherein the at least one ion emitter is in a housing on the handle, wherein the housing has a front and at least one side, and an air inlet and an air outlet on opposite sides of the housing, and wherein the air inlet and the air outlet are positioned on the handle, wherein the air inlet is through the side of the handle and has openings to allow air therethrough, and wherein the air outlet is through the front of the handle and has openings to allow air therethrough.

2. The hair styling apparatus of claim 1, wherein the housing has an airflow generator that draws air into the air inlet and expels air through the air outlet.

3. The hair styling apparatus of claim 2, wherein the airflow generator is a fan in the housing.

4. The hair styling apparatus of claim 1, wherein the ion emitter has a positive ion emitter and a negative ion emitter.

5. The hair styling apparatus of claim 1, wherein the ion emitter is a first ion emitter and further comprising a second ion emitter.

6. The hair styling apparatus of claim 5, wherein the first ion emitter is in a first housing that is connected to the handle and the second ion emitter is in a second housing that is connected to the handle, and wherein the first housing has the air inlet and the air outlet and the second housing has an air inlet and an air outlet.

7. The hair styling apparatus of claim 6, further comprising an airflow generator that draws air into the air inlet of the first housing and expels air through the air outlet of the first housing generating an airflow including positive and negative ions out of the first housing.

8. The hair styling apparatus of claim 6, further comprising a first airflow generator that draws air into the air inlet of the first housing and expels air through the air outlet of the first housing and a second airflow generator that draws air into the air inlet of the second housing and expels air through the air outlet of the second housing.

9. The hair styling apparatus of claim 1, wherein the first member and the second member are in the approximated position when in a curling configuration, and further comprising a clamp segment connected to the first member configured for relative movement between a spaced apart position for receiving hair between the clamp segment and the first member and a closed position.

10. The hair styling apparatus of claim 9, wherein the clamp segment is configured to be in the closed position while the first and second members are movable between the open position and the approximated position in a straightening configuration.

11. The hair styling apparatus of claim 9, wherein the clamp segment is connected to a lever that selectively moves the clamp segment between the spaced apart position and the closed position, and wherein the lever has a button that is movable between a straightening position for the straightening configuration and a curling iron position for the curling configuration.

12. The hair styling apparatus of claim 11, wherein, when the button is in the curling iron position, the button disconnects the lever from the first member so that only the clamp segment moves with the lever and, when the button is in the straightener position, the button connects the first member to the lever so that the first member moves with the lever.

13. A hair styling apparatus comprising:

a first member and a second member extending along a central longitudinal axis, the first member and the second member being configured for relative movement between an open position for receiving hair therebetween and an approximated position, the first member and second member each including an inner plate segment and an outer shell segment, wherein the first member and the second member are each configured to impart a straightening effect on hair when clamped with the inner plate segment, a heating assembly connected via the inner plate segment to the first member and the second member; and at least one ion emitter for generating ions upon activation of the hair styling apparatus that is in a housing on a handle, wherein the first member, the second member and the handle are configured for relative movement between an extended position and a folded position, wherein the housing has a front and at least one side, and an air inlet and an air outlet on opposite sides of the housing, wherein the air inlet and the air outlet are positioned on the handle, wherein the air inlet is through the side of the handle and has openings to allow air therethrough, and wherein the air outlet is through the front of the handle and has openings to allow air therethrough.

* * * * *